US005431039A

United States Patent [19]

Goodman et al.

[11] Patent Number: 5,431,039

[45] Date of Patent: Jul. 11, 1995

[54] FENDER WELL PRESS

[75] Inventors: Danny R. Goodman, Hawkins; James M. Turner, Sullivan; Richard D. Hicks, Washington, all of Tenn.

[73] Assignee: GTH, Inc., Kingsport, Tenn.

[21] Appl. No.: 149,634

[22] Filed: Nov. 9, 1993

[51] Int. Cl.[6] ..... B21D 1/12

[52] U.S. Cl. ..... 72/447; 72/705

[58] Field of Search ..... 72/392, 447, 457, 458, 72/705; 254/93 VA

[56] References Cited

U.S. PATENT DOCUMENTS

| | | | |
|---|---|---|---|
| 1,775,968 | 9/1930 | Nelson | 72/458 |
| 2,093,284 | 9/1937 | Mandl | 72/705 |
| 4,117,709 | 10/1978 | Jackson | 72/704 |
| 4,171,631 | 10/1979 | Butts | 72/54 |
| 4,495,791 | 1/1985 | Kemnitz et al. | 72/453.02 |
| 4,748,842 | 6/1988 | Dingman | 72/457 |
| 5,101,654 | 4/1992 | Stevens | 72/447 |
| 5,119,667 | 6/1992 | Hollis et al. | 72/453.16 |

*Primary Examiner*—Lowell A. Larson
*Attorney, Agent, or Firm*—Pitts & Brittian

[57] ABSTRACT

A fender well press (10) for pressing out the fender well of an automobile which has been damaged as a result of a collision. The fender well press (10) includes an adaptor ring (16) defining a plurality of openings (18) in a manner substantially similar to that of the wheel. A cylinder (22) is secured at one end and extends away from the wheel hub. A second cylinder (28) may be provided to closely encompass the first cylinder (22), the second cylinder (28) selectively pivoting about the first cylinder (22). A mounting plate (40) is carried by the first or second cylinder (22,28) for mounting a piston member (44) thereon. The piston member (44) may be any conventional piston (44) such as an air cylinder. A two-way valve (100) is in fluid communication with the piston member (44) at each end and with a fluid source to control the direction and distance of travel. A fender hammer (88) is secured to the piston shaft (74) and is comprised of a mounting block (90) and an engagement member (94). The engagement member (94) defines a top surface (96) having a selected contour for engaging the sheet metal to be reformed. An engagement pad (98) is carried by the top surface (96) of the engagement member (94) for protecting the surfaces of the engagement member (94) and the sheet metal.

15 Claims, 4 Drawing Sheets

FENDER WELL PRESS

TECHNICAL FIELD

This invention relates to the field of automobile body repair. More specifically, this invention relates to a tool which may be used in the repair of automobile body damage sustained especially in the fender wells of race cars due to collisions with other cars or with a retaining wall or other barrier.

BACKGROUND ART

In the field of racing, it is well known that individual cars tend to bump each other during the course of a race. Further, cars may collide with a side retaining wall or other barrier. These types of collisions often cause the metal defining one or more of the fender wells to deform. It is also well known that these types of collisions often cause the metal to tear.

The metal is often so deformed and torn such that the respective tires are either damaged or are in danger of being damaged from contact with the metal. Therefore, it is necessary in these instances to repair the damaged material in order to prevent further damage to the tires. To this extent, it is desirable to reform the metal to closely approximate the original contour of the interior of the fender well.

Due to the nature of automobile racing, it is well known that it is necessary to minimize time spent in the "pit". Therefore, it is important to make necessary repairs in a suitable fashion and in a time-efficient manner.

Several devices have been produced to remove dents from automobile bodies. Typical of the art are those devices disclosed in the following U.S. Pat. Nos.:

| U.S. Pat. No. | Inventor(s) | Issue Date |
|---|---|---|
| 4,171,631 | C. L. Butts | Oct 23, 1979 |
| 4,495,791 | J. E. Kemnitz, et al. | Jan 29, 1985 |
| 4,748,842 | B. W. Dingman | Jun 7, 1988 |
| 5,101,654 | J. F. Stevens | Apr 7, 1992 |
| 5,119,667 | F. C. Hollis, et al. | Jun 9, 1992 |

Of these devices, the Butts ('631) device is used to restore a deformed outer vehicle panel to its original contour by using an inflatable air bag. The air bag is placed between the outer and inner panels of the particular panel proximate the deformed portion, after which it is inflated. Once the air bag is inflated such that both the inner and outer panels are engaged, pressure gradually increases until the outer panel is reformed.

This type of device, however, is only useful for removing dents where an opposing wall is provided for helping retain the position of the air bag while being inflated and for aiding in the creation of pressure sufficient to force the dent out. Further, due to the nature of an inflatable bag, the '631 device is most practical in situations where the surfaces between which it is to be placed are generally smooth in order to prevent unintentional puncturing of the bladder of the air bag.

The device disclosed by Kemnitz, et al. ('791) includes a threaded point which is used to engage the sheet metal. The threaded point is driven into the sheet metal and then pulled back, thus pulling the dent out. However, it is necessary to further injure the surface of the metal in order to operate this device. Further, for the type of damage that has been described for race cars, the '791 device would have to be used in several locations in order to closely restore the original contour of the fender well. At each location where the '791 device is used, the inventors have disclosed that several repetitions of the pulling process are required.

Those devices disclosed by Dingman ('842) and Stevens ('654) both use vertical frames or supports which are secured to a floor surface. One or more chains or tension wires are secured to the automobile body at the point or points to be pulled. One or more winches are then operated to pull the tension wires, thus pulling the sheet metal. Again, this procedure must be performed at several locations in order to completely pull the dents from the automobile body. At each location, a considerable amount of time may be spent in setting up the devices in order to pull the dent, and further, a considerable amount of time may be required to operate the devices as well.

The device disclosed by Hollis, et al. ('667) is a pneumatically operated hammer which includes an air-driven piston which reciprocates rapidly back and forth, thus creating the hammering force. For body damage of the nature that race cars sustain as described, this type of device must be operated from within the fender well in order to push the dent out and to approximate the original contour. It is well known that working within a fender well that has sustained a collision of this nature may cause injury to the person or persons working to repair the sheet metal as tears in the sheet metal tend to occur, thus causing jagged edges to cut the hands and arms of the person or persons.

Although operation of a device from within the fender well is not altogether undesirable, a device of this nature must be held by hand such that the operator of the device must also be at least partially within the fender well during operation. It is undesirable to have any portion of the operator within the fender well during operation of the selected equipment.

None of the prior art devices made of record disclose the use of a single stroke mechanical device for pushing out dents in order to closely approximate original contours of a dented portion of an automobile. Specifically, none of the prior art references made of record disclose the use of the device to reform sheet metal proximate a fender well using a single stroke press the metal away from the fender well.

Therefore, it is an object of this invention to provide a means for reforming damaged sheet metal of an automobile fender well in order to conform it closely to its original contours in order to prevent damage from occurring to the tires of the automobile.

It is another object of the present invention to provide such a means whereby the damaged sheet metal may be reformed in a local region using a single stroke of the engagement portion of the device.

Another object of the present invention is to provide such a means which may be operated from within the fender well in order to push the sheet metal into the selected configuration.

Still another object is to provide such a means which may be operated from within the fender well while not requiring the entry of any part of the operator into the fender well during operation of the device.

Yet another object of the present invention is to provide a means whereby sheet metal proximate a fender well may be reformed after a collision, the device being easily secured and removed from the axle hub of the automobile.

Still another object of the present inventions to provide a means for reforming sheet metal proximate a fender well while reducing the risk of injury to the operator.

DISCLOSURE OF THE INVENTION

Other objects and advantages will be accomplished by the present invention which is designed for being secured to the wheel hub of an automobile and pneumatically actuated in order to press out the sheet metal defining the fender well which has been damaged as a result of a collision. The fender well press is designed such that a single cycle of operation is required in order to press the sheet metal to a configuration which will provide sufficient clearance between the fender well and the tire after the tire is replaced.

An adaptor hub is provided for securing the fender well press of the present invention to the appropriate automobile wheel hub. A pressing mechanism is secured to the adaptor hub and is used for engaging the deformed sheet metal and pressing it into a configuration approximate its original contour, or at least enough to insure an appropriate clearance between the reformed sheet metal and the tire.

The adaptor hub of the present invention is composed of an adapter ring and a cylinder affixed thereto. The adaptor ring defines a plurality of opening radially about its perimeter in order to engage the wheel hub in a manner substantially similar to that of the wheel. The cylinder is secured at one end and extends away from the wheel hub.

A second cylinder may be provided to closely encompass the first cylinder. The second cylinder may pivot freely about the first cylinder. A retainer is fixed to the first cylinder in order to prevent axial movement of the second cylinder with respect to the first cylinder. The adaptor ring serves a similar function of the first end of the cylinders. In the event that pivotal motion of the second cylinder with respect to the first cylinder is undesirable, a position locking device may be provided to halt such motion. In the event that rotation of the second cylinder with respect to the first cylinder is undesirable altogether, the second cylinder may be omitted, and therefore the retainer may be omitted as well. A mounting plate is carried by the second cylinder for mounting a piston member thereon. In the embodiment wherein a second cylinder is not incorporated, the mounting plate is carried by the first cylinder.

The piston member may be any conventional piston such as an air cylinder. A two-way valve is in fluid communication with the piston member at each end to control the direction and distance of travel. The two-way valve is also in fluid communication with at least a fluid source.

A fender hammer is secured to the piston shaft and is comprised of a mounting block and an engagement member. The mounting block is secured to the piston shaft and the engagement member is permanently secured to the mounting block. The engagement member defines a top surface having a selected contour for engaging the sheet metal to be reformed. An engagement pad is carried by the top surface of the engagement member for protecting the surfaces of the engagement member and the sheet metal.

The fender well press provides a means for pressing out dents in the fender well area of an automobile caused by collisions to the side. The fender well press may be used to quickly remove a substantial portion of these types of dents in order to reduce the amount of time spent in the pit area of a race track. Further, the fender well press of the present invention is operable in such a manner as to reduce the likelihood of a crew person being injured from the sharp edges of the sheet metal, as is the case where the crew person is required to reach into the fender well and hammer the metal out by hand.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A fender well press incorporating various features of the present invention is illustrated generally at 10 in the figures. The fender well press 10 is designed for being secured to the wheel hub of an automobile and pneumatically actuated in order to press out the sheet metal defining the fender well which has been damaged as a result of a collision. The fender well press 10 is designed such that a single cycle of operation is required in order to press the sheet metal to a configuration which will provide sufficient clearance between the fender well and the tire after the wheel is replaced.

Figure 1:
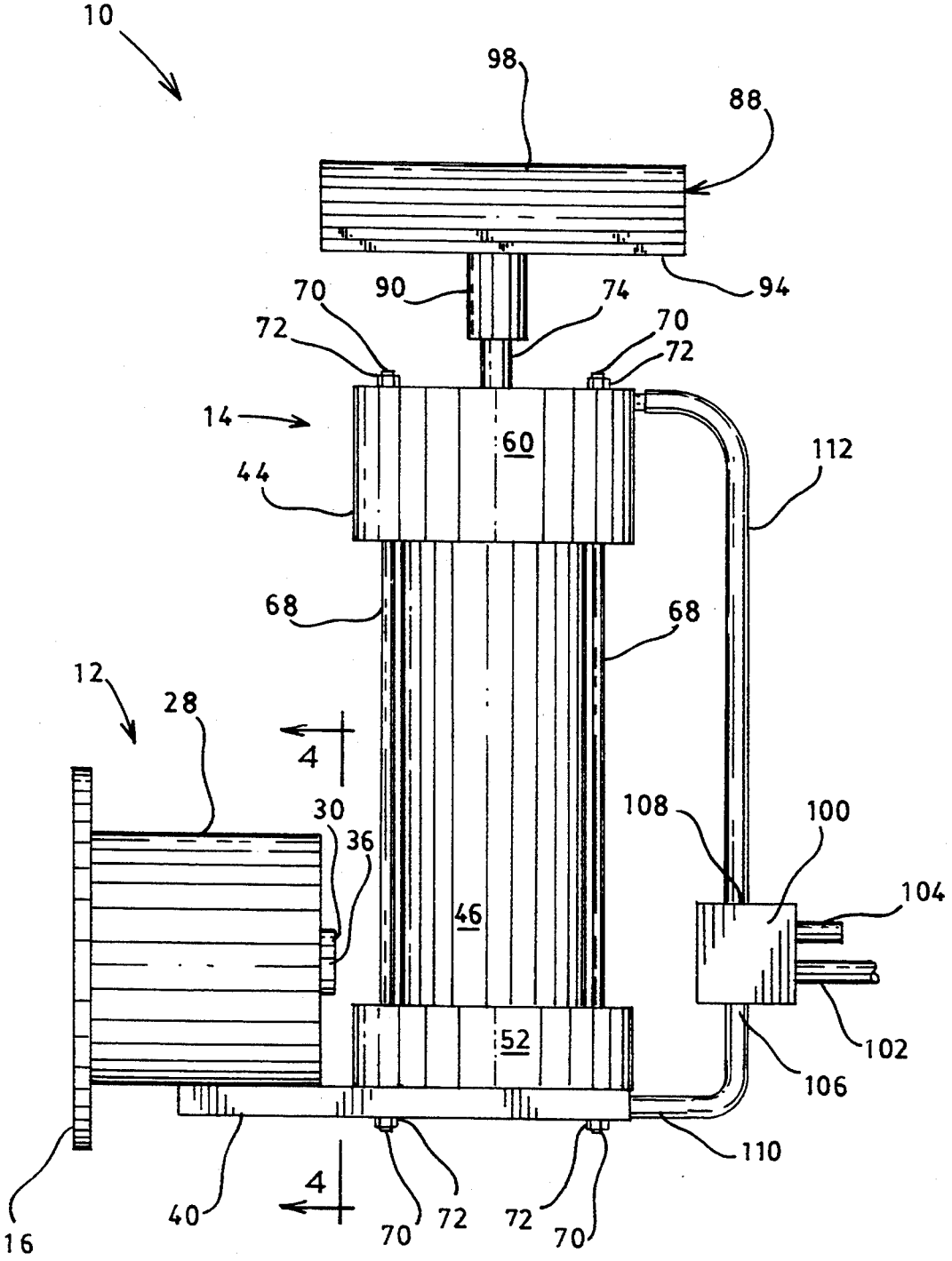
FIG. 1 is a side elevation view of the fender well press constructed in accordance with several features of the present invention.

As illustrated in FIG. 1, an adaptor mechanism 12 is provided for securing the fender well press 10 of the present invention to the appropriate automobile wheel hub. A pressing mechanism 14 is secured to the adaptor mechanism 12 and is used for engaging the deformed sheet metal and pressing it into a configuration approximate its original contour, or at least enough to insure an appropriate clearance between the reformed sheet metal and the tire.

The adaptor mechanism 12 of the present invention is an adapter ring 16 having a cylinder 22 affixed thereto. The adaptor ring 16 is configured to engage the wheel hub in a manner substantially similar to that of the wheel. To this extent, a plurality of openings 18 is defined about the periphery of the adaptor ring 16 for receiving the mounting studs otherwise used to mount the tire on the hub. A central opening 20 is defined by the adaptor ring 16 and is dimensioned to receive any extending portions (not shown) of the hub.

The cylinder 22, or first cylinder member 22, is secured at one end 24 to the adaptor ring 16 and terminates at a second end 26. The first cylinder member 22 may be secured in any selected manner. As shown, the preferred method of securement is by welding.

Figure 4:
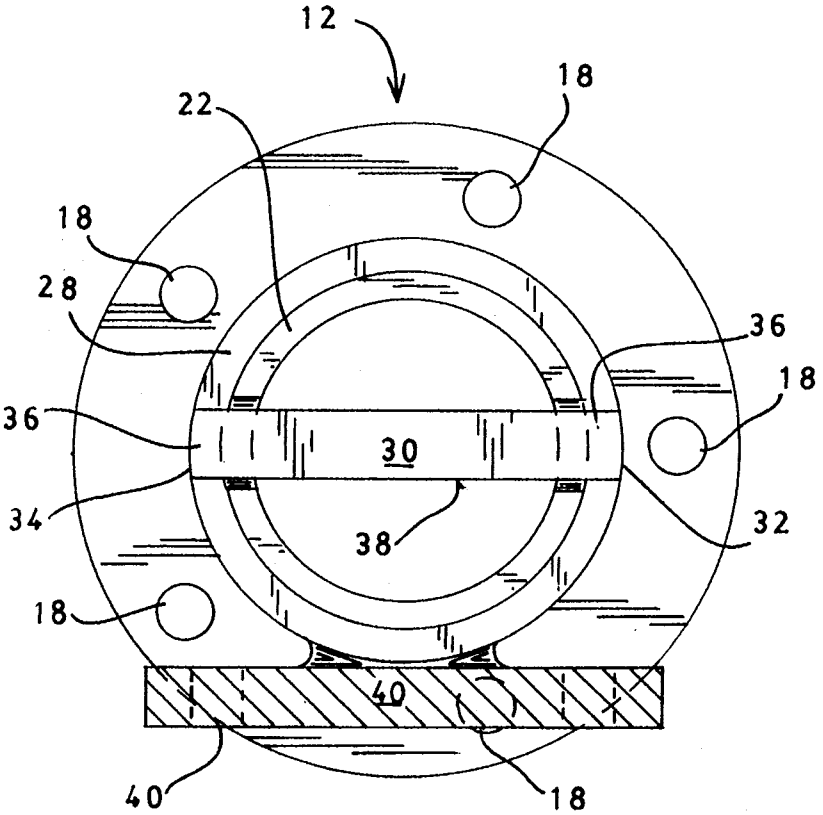
FIG. 4 is a front elevation view, shown partially in section, of the fender well press taken along lines 4—4 in FIG. 3.

A second cylinder member 28 may be provided to closely receive the first cylinder member 22. The second cylinder member 28 is dimensioned such that it may pivot freely about the first cylinder member 22. In order to prevent movement of the second cylinder member 28 in an axial direction, the first and second cylinder members 22,28 each define a length substantially equal to that of the other. Further, a retaining member 30 is provided. The retaining member 30 of the preferred embodiment is secured to the second end 26 of the first cylinder 22 and defines first and second ends 32,34, each of which extends beyond the first cylinder member 22 and over the second cylinder member 28. This is best illustrated in FIG. 4. It is envisioned that the central portion 38 of the retaining member 30 may be omitted, leaving only the portions secured to the first cylinder member 22 and those portions 36 extending over the second cylinder member 28. To this extent, it is further envisioned that any selected arrangement and number of such portions may be incorporated to prevent the second cylinder member 28 from being unselectively removed from the around the first cylinder member 22. Other conventional means for fixing the axial position of the second cylinder member 28 with respect to that of the first cylinder member 22 may be incorporated as well.

In the event that pivotal motion of the second cylinder member 28 with respect to the first cylinder member 22 is undesirable, it is foreseeable that, though not shown, a position locking device may be provided to halt such motion. For instance, in order to lock the position of the second cylinder member 28 with respect to the first cylinder member 22 at discrete locations, cooperating through openings may be defined by both the first and second cylinder members 22,28 for receiving a conventional locking pin. Other means such as a thumb screw received by the second cylinder member 28 with a terminating end to engage the outer surface of the first cylinder member 22 may also be used to lock the rotational positions of the first and second cylinder members 22,28 at an infinite number of positions.

In the event that rotation of the second cylinder member 28 with respect to the first cylinder member 22 is undesirable altogether, the second cylinder member 28 may be omitted. In this embodiment, the retaining member 30 is obviated and, therefore, may be omitted as well. This embodiment may be selected when the fender well press 10 is secured to a wheel hub that is capable of being turned by hand. Thus, the wheel hub and fender well press 10 may both be turned to selectively orient the fender well press 10 with respect to the fender well.

A mounting plate 40 is carried by the second cylinder member 28 for mounting the pressing mechanism 14 thereon, the pressing mechanism 14 including at least a selected piston member 44. Though not shown, in the embodiment wherein a second cylinder member 28 is not incorporated, the mounting plate 40 is carried by the first cylinder member 22. The mounting plate 40 of the preferred embodiment extends away from the wheel hub such that the piston member may operate in a direction perpendicular to the axle. However, the mounting plate 40 may be otherwise configured to vary the direction of operation of the piston member 44.

Figure 5:
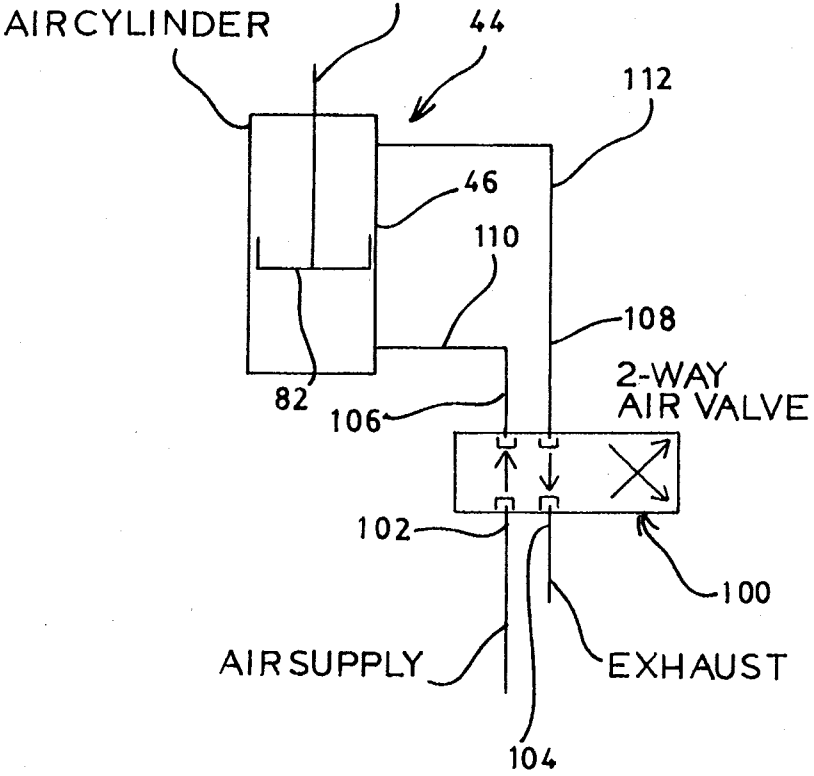
FIG. 5 illustrates a schematic diagram of a pneumatic operator used in association with the present invention.

The piston member 44 of the preferred embodiment includes a cylinder 46 into which a selected fluid is forced. The selected fluid may be air as indicated in FIG. 5, or may be any other substantially incompressible fluid such as hydraulic fluid. The piston member 44 of the preferred embodiment may be any selected piston member 44 conventionally available, such as the Model No. A6C33B1 manufactured by Moser.

Proximal and distal heads 52,60 are provided at either end 48,50 of the cylinder 46, respectively. A plurality of rod members 68 having oppositely disposed threaded ends 70 is received through cooperating openings defined by the proximal and distal heads 52,60 and the mounting plate 40. Threaded nuts 72 are secured to the threaded ends 70 of the rod members 68, thereby securing the individual components of the piston member 44 one to another and to the mounting plate 40. Other means for securement may be incorporated as well.

Figure 3:
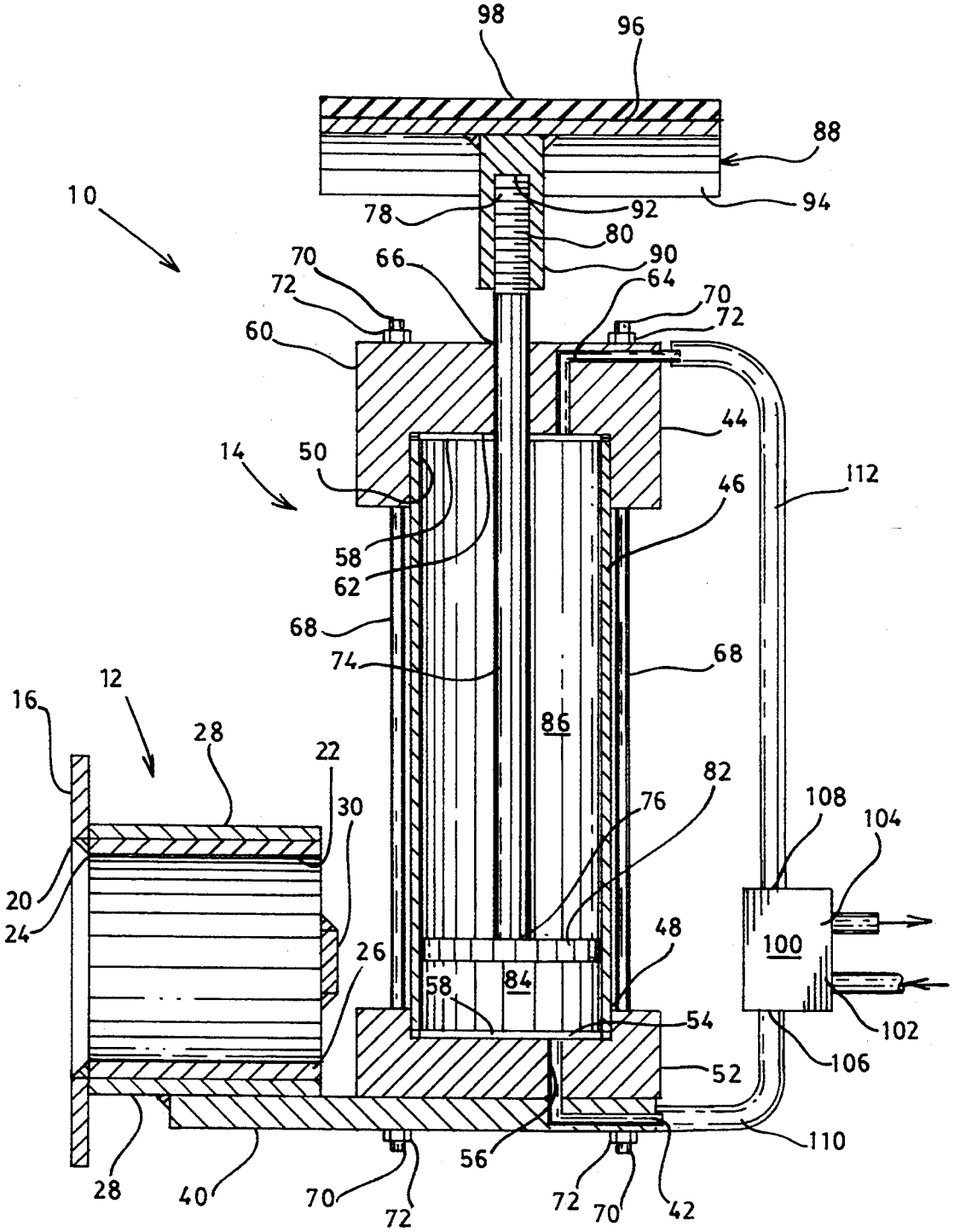
FIG. 3 is a side elevational view, in section, of the fender well press taken along lines 3—3 in FIG. 2.

As shown in FIG. 3, the proximal head 52 of the piston member 44 defines a recess 54 dimensioned to closely receive a first end 48 of the cylinder 46. In order to prevent fluid communication between the cylinder 46 and the proximal head 52, a seal member 58 may be inserted therebetween.

An opening 56 is defined by the proximal head 52 to cooperate with an opening 42 defined by the mounting plate 40 in order to provide fluid communication with a fluid source. In the present invention, as indicated in FIG. 5, the preferred fluid source is a selected air supply. The openings 56,42 defined by the proximal head 52 and the mounting plate 40 may serve as an inlet or an outlet, depending upon the direction of travel of the piston shaft 74. It will be obvious that the opening 56 in the proximal head 52 may be in direct fluid communication with the fluid source without necessitating the opening 42 defined by the mounting plate 40. Therefore, it is not intended that the present invention be limited to such a disclosure.

The distal head 60 of the piston member 44 defines a recess 62 dimensioned to closely receive a second end 50 of the cylinder 46. In order to prevent fluid communication between the cylinder 46 and the distal head 60, a seal member 58 similar to that described above may be inserted therebetween.

An opening 64 is defined by the distal head 60 to provide fluid communication with the fluid source. The opening 64 defined by the distal head 60 may serve as an inlet or an outlet, depending upon the direction of travel of the piston shaft 74. It will be seen that when the distal head fluid opening 64 serves as an outlet, the cooperating openings 56,42 defined by the proximal head 52 and mounting plate 40 will serve as a fluid inlet, and vice versa.

A through opening 66 is defined in the central portion of the distal head 60 for the passage of the piston member shaft 74. The opening 66 defines a longitudinal axis parallel to the longitudinal axis of the cylinder 46. In the preferred embodiment, these two axes are co-linear. The cross-sectional configuration of the opening 66 is defined to be substantially similar, but slightly larger than, the cross-sectional configuration of the piston member shaft 74. Although illustrated in the figures as circular, it is envisioned that the cross-section of the piston member shaft 74 may define any other geometric configuration. Other configurations as suggested may provide for the prevention of rotation of the shaft 74 with respect to the distal head 60. These cross-sectional configurations may include circular defining a notch, oval, egg-shaped, square, triangular, or any other selected configuration.

The cylinder 46 defines an outer diameter dimensioned to be closely received within the recesses 54,62 defined by the proximal and distal heads 52,60, respectively. An inside diameter is defined to closely receive a diaphragm 82. Thus, a proximal volume 84 is defined between the diaphragm 82, the proximal head 52, and a portion of the cylinder wall 46, and a distal volume 86 is defined between the diaphragm 82, the distal head 60, and the remaining portion of the cylinder wall 46. As pressure is applied to a selected side of the diaphragm 82, the diaphragm 82 will move away from the pressure, thus reducing one of the volumes 84,86 and increasing the other. As alluded to previously, the fluid inlets 42,56,64 defined by the mounting plate 40 and the proximal and distal heads 52,60 allow for the application of pressure to a selected side of the diaphragm 82.

A piston shaft 74 is secured at one end 76 to the distal side of the diaphragm 82. Thus, as the diaphragm 82 is moved in a selected direction, the piston shaft 74 is coincidentally moved. As previously described, the piston shaft 74 is received through a central through opening 66 defined by the distal head 60. The piston shaft 74 defines a length such that as the diaphragm 82 is positioned closest to the proximal head 52, the distal end 78 of the piston shaft 74 extends out of and away from the distal head 60.

In the preferred embodiment, a portion 80 of the distal end 78 of the piston shaft 74 is threaded. A fender hammer 88, comprised of a mounting block 90 and an engagement member 94, is secured to the piston shaft 74 proximate the threaded portion 80. To this end, the mounting block 90 defines a threaded recess 92 for engageably receiving the piston shaft threaded portion 80. Any other conventional means may be used as well in order to secure the mounting block 90 to the piston shaft 74.

The engagement member 94 is secured to the mounting block 90 in a selected manner. As illustrated in the figures, the mounting block 90 and engagement member 94 of the preferred embodiment are secured one to the other by welding. Other conventional methods of securement may be used as well.

Figure 2:
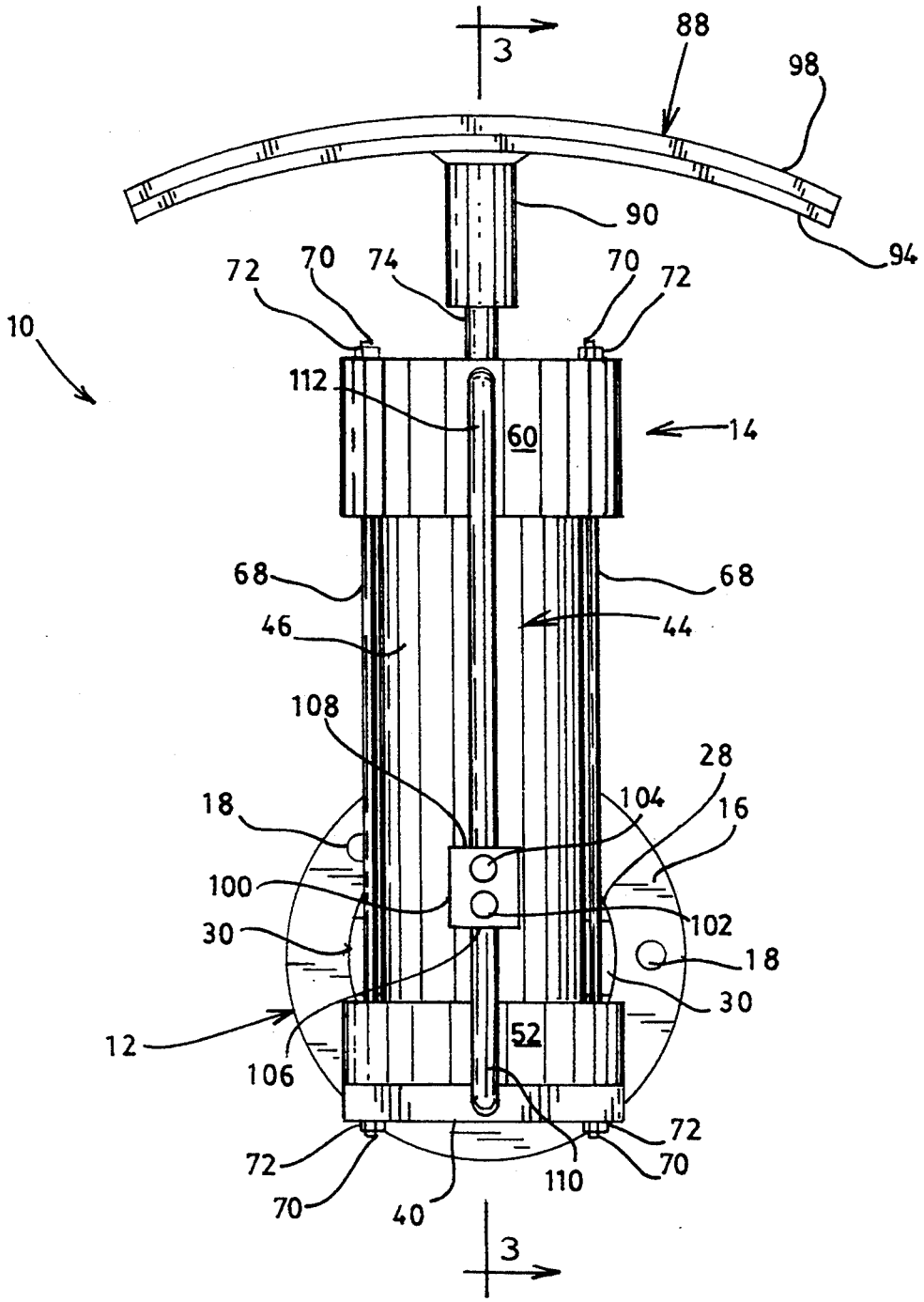
FIG. 2 is a front elevation view of the fender well press shown in FIG. 1.

The engagement member 94 defines a top surface 96 having a selected contour for engaging the sheet metal to be reformed. In the illustrated embodiment, the top surface 96 of the engagement member 94 defines an arcuate cross-section in the direction shown in FIG. 2 and a linear cross-section in the direction shown in FIGS. 1 and 3. However, any other contour may be defined dependent upon the desired contour of the sheet metal being deformed. It will be seen that the engagement member 94 may be selectively removed for the securement of another selected engagement member 94 by separating the mounting block 90 from the piston shaft 74.

An engagement pad 98 is carried by the top surface 96 of the engagement member 94. The engagement pad 98 serves to protect the surfaces of the engagement member 94 and the sheet metal. In the preferred embodiment, the engagement pad 98 is fabricated from a rubber material such as a three-ply reinforced rubber belting.

A fluid direction control device 100 is provided for selected the direction of flow of fluid into and out of the piston cylinder 46. In the preferred embodiment, the fluid direction control device 100 is comprised of a two-way control valve 100 having a fluid inlet 102, a fluid exhaust 104, a pair of fluid inlet/outlets 106,108, and a switch (not shown). One each of the pair of fluid inlet/outlets 106,108 is in communication with the fluid inlets 42,56,64 defined by the mounting plate 40 and the proximal and distal heads 52,60. A selected conduit 110 is provided for fluid communication between the fluid inlet/outlet 106 and the fluid inlet 56 defined by the proximal head 52 and a selected conduit 112 is provided for fluid communication between the fluid inlet/outlet 108 and the fluid inlet 64 defined by the distal head 60.

The fluid inlet 102 is in fluid communication with the fluid source. In the preferred embodiment, the fluid source is an air supply such as an air compressor. The fluid exhaust 104 is in fluid communication with the atmosphere in the event the selected fluid is air, or with an appropriate reservoir (not shown) in the event some other fluid is used. In the latter event, it will be understood that a closed system may be used by drawing fluid from and exhausting fluid to the same reservoir.

The switch is provided for changing the direction of flow within the piston cylinder 46. In a first position, the switch allows fluid to flow toward the proximal head 52 and away from the distal head 60. In a second position, a reverse flow will be attained. In the illustrated embodiment, the fluid flow, during operation, will be continuously in the same direction through the fluid inlet 102 and the fluid exhaust 104, independent of the fluid flow through the fluid inlet/outlets 106,108.

As mentioned, the fender well press 10 of the present invention is used after an automobile has sustained a collision wherein the fender is damaged, especially when the collision is in the course of an automobile race. When such an injury has occurred, the wheel is removed, thus revealing the wheel hub. The removal of the wheel also clears the fender well in order to provide adequate clearance for its repair.

The fender well press 10 of the present invention may then be secured to the wheel hub in a fashion similar to the securement of the wheel. The existing studs are received through the openings 18 defined by the adaptor ring 16 and the lug nuts are secured on the studs. The piston member 44 is then moved to a selected position by rotating the second cylinder member 28 around the first cylinder member 22, or by turning the wheel hub in the event that first and second cylinder members 22,28 are not both provided.

The two-way control valve 100 is then actuated to allow fluid to be inlet to the proximal end 48 of the piston cylinder 46, thus forcing the diaphragm 82 toward the distal head 60. The piston shaft 74 is forced in the same direction, causing the fender hammer 88 to engage the damaged sheet metal and force away from the wheel hub a selected distance. After the sheet metal has been pressed the selected distance away from the wheel hub, or has been reshaped to the selected contour, the two-way switch is reversed, thus causing the reversal of motion of the diaphragm 82, piston shaft 74, and fender hammer 88.

The fender well press 10 is then removed from the wheel hub and the wheel is replaced. When the wheel is replaced, a sufficient clearance is provided between the fender and the wheel to allow the automobile to operate without causing harm to the tires. It will be noted that only a single repetition is required to achieve the desired results. It will be necessary in some instances, however, to reposition the piston member 44 in order to reform the sheet metal at a different location, especially after collisions which cause greater damage.

From the foregoing description, it will be recognized by those skilled in the art that a fender well press offering advantages over the prior art has been provided. Specifically, the fender well press provides a means for pressing out dents in the fender well area of an automobile caused by collisions to the side. The fender well press of the present invention may be used to quickly remove a substantial portion of these types of dents in order to reduce the amount of time spent in the pit area of a race track. Further, the fender well press of the present invention is operable in such a manner as to reduce the likelihood of a crew person being injured from the sharp edges of the sheet metal, as is the case where the crew person is required to reach into the fender well and hammer the metal out by hand.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, We claim:

1. A fender well press for pressing dents from sheet metal defining an automobile fender well, said fender well press comprising:

an adaptor mechanism for securing said fender well press to a wheel hub of an automobile, said adaptor mechanism including an adaptor ring releasably securable to the wheel hub, a first cylinder member secured at a first end to said adaptor ring, a second cylinder member configured to receive said first cylinder member, and a retaining member for limiting movement of said second cylinder in relation to said first cylinder member to rotational movement about a longitudinal axis; and an engagement mechanism secured at one end to said second cylinder member for engaging said sheet metal and pressing said sheet metal away from said wheel hub a selected distance.

2. The fender well press of claim 1 wherein said engagement mechanism includes at least a piston member having a shaft capable of reciprocal movement toward and away from said sheet metal.

3. The fender well press of claim 2 wherein said piston member is pneumatically operable.

4. The fender well press of claim 2 wherein said piston member is hydraulically operable.

5. The fender well press of claim 2 wherein said sheet metal is moved said selected distance by operation of said piston member through one complete cycle.

6. The fender well press of claim 2 wherein said engagement mechanism includes an engagement head carried by said piston member shaft and defining an engagement surface having a selected contour.

7. The fender well press of claim 6 wherein said engagement mechanism further includes a protective engagement pad carried by said engagement head proximate said engagement surface, said protective engagement pad being disposed between said engagement head and said sheet metal during operation of said fender well press.

8. The fender well press of claim 6 wherein said engagement head is selectively removable from said piston member shaft for replacement and for exchange with at least one other said engagement head having another said engagement surface defining another said selected contour.

9. The fender well press of claim 1 wherein said retaining member is secured to a second end of said first cylinder member and defines at least one extended portion, each said at least one extended portion extending away from said longitudinal axis, said second cylinder member being disposed between said at least one extended portion and said adaptor ring.

10. A fender well press for pressing dents from sheet metal defining an automobile fender well, said fender well press comprising:

an adaptor mechanism for securing said fender well press to a wheel hub of an automobile, said adaptor mechanism including an adaptor ring releasably securable to the wheel hub, a first cylinder member secured at a first end to said adaptor ring, a second cylinder member configured to receive said first cylinder member, and a retaining member for limiting movement of said second cylinder in relation to said first cylinder member to rotational movement about a longitudinal axis, said retaining member being secured to a second end of said first cylinder member and defining at least one extended portion, each said at least one extended portion extending away from said longitudinal axis, said second cylinder member being disposed between said at least one extended portion and said adaptor ring; and an engagement mechanism secured at one end to said second cylinder member for engaging said sheet metal and pressing said sheet metal away from said wheel hub a selected distance, said engagement mechanism including at least a piston member having a shaft member capable of reciprocal movement toward and away from said sheet metal, and an engagement head carried by said piston member shaft and defining an engagement surface having a selected contour.

11. The fender well press of claim 10 wherein said piston member is pneumatically operable.

12. The fender well press of claim 10 wherein said piston member is hydraulically operable.

13. The fender well press of claim 10 wherein said sheet metal is moved said selected distance by operation of said piston member through one complete cycle.

14. The fender well press of claim 10 wherein said engagement mechanism further includes a protective engagement pad carried by said engagement head proximate said engagement surface, said protective engagement pad being disposed between said engagement head and said sheet metal during operation of said fender well press.

15. The fender well press of claim 10 wherein said engagement head is selectively removable from said piston member shaft for replacement and for exchange with at least one other said engagement head having another said engagement surface defining another said selected contour.

* * * * *